US005752656A

United States Patent [19]

Horling

[11] Patent Number: 5,752,656

[45] Date of Patent: May 19, 1998

[54] NOZZLE ASSEMBLY AND METHOD OF FABRICATION THEREOF

[75] Inventor: Timothy J. Horling, Sullivan, Wis.

[73] Assignee: Outboard Marine Corporation, Waukegan, Ill.

[21] Appl. No.: 677,884

[22] Filed: Jul. 10, 1996

[51] Int. Cl.[6] ..... F02M 61/08

[52] U.S. Cl. ..... 239/1; 239/453; 239/459; 239/600

[58] Field of Search ..... 239/453–456, 239/459, 533.9, 600, 1; 29/888.4, 888.43, 890.12

[56] References Cited

U.S. PATENT DOCUMENTS

| | | | |
|---|---|---|---|
| 2,834,097 | 5/1958 | Butler | 29/157.1 |
| 4,034,917 | 7/1977 | Bailey | 239/453 |
| 4,181,144 | 1/1980 | Landen | 239/453 |
| 4,341,351 | 7/1982 | DeLuca | 239/453 |
| 4,350,301 | 9/1982 | Erwin et al. | 239/453 |
| 4,356,978 | 11/1982 | Krauss | 239/453 |
| 4,790,055 | 12/1988 | Raufeisen et al. | 29/156.7 R |
| 5,438,754 | 8/1995 | Mori | 29/888.43 |
| 5,472,013 | 12/1995 | Irgens | 137/541 |

*Primary Examiner*—Kevin Weldon
*Attorney, Agent, or Firm*—Jones, Day, Reavis & Pogue

[57] ABSTRACT

Disclosed herein is a nozzle assembly comprising a housing including an outer end, an inner end, a central bore extending between the inner and outer ends and including a valve seat adjacent the outer end of the housing, and a spring seat extending transversely to the central bore, a needle member located in the central bore, moveable relative to the housing between an open position and a closed position, and including a valve surface engaged with the valve seat when the needle member is in the closed position, and an inner end, a needle retainer fixed to the needle member in spaced relation to the inner end of the housing and so as to engage the inner end of the housing when the needle member is in the open position, a spring retainer fixed to the inner end of the needle member, and a spring normally biasing the needle member to the closed position and including a first end bearing against the spring seat of the housing, and a second end bearing against the spring retainer.

5 Claims, 1 Drawing Sheet

NOZZLE ASSEMBLY AND METHOD OF FABRICATION THEREOF

BACKGROUND OF THE INVENTION

The invention relates generally to nozzle assemblies for fuel injectors and the like, and, more particularly, to nozzle assemblies of the type wherein the valve member or needle is held in the closed position in engagement with the housing by a spring and wherein the valve member or needle moves axially outwardly away from the housing from the closed position to the open position.

The invention also relates to methods of fabricating such nozzle assemblies.

One prior nozzle assembly included four parts; a needle, a housing, a retainer, and a spring, as shown in U.S. Pat. No. 5,472,013, issued Jul. 18, 1994, which patent is incorporated herein by reference. During fabrication of this prior nozzle assembly, the needle was inserted in the central bore of the housing, the spring was placed on the housing spring seat and in surrounding relation to the adjacent projecting end of the needle, and the retainer (which forms the opposite spring seat) was placed onto the projecting end of the needle. The needle lift was then set, (i.e., the maximum distance of the valve surface on the needle from the valve seat on the housing which occurs when the valve assembly is in the fully open position), possibly with a shim, and the retainer was welded to the projecting end of the needle to complete the assembly. The disadvantage of this prior method is that the installed height of the spring (i.e., the length of the spring when the valve assembly is in the closed position) is controlled by the dimensions of the parts and the needle lift setting. In turn, the spring installed height controls the spring preload which should be accurately controlled. Since the installed height is defined as explained above, in order to hold the spring preload to desired accuracies, the preload or spring force tolerance of the spring must be held to accuracies economically beyond current spring manufacturing methods.

Attention is directed to U.S. Pat. No. 2,834,097, issued May 13, 1958, and to U.S. Pat. No. 4,790,055, issued Dec. 13, 1988.

Attention is also directed to U.S. patent application Ser. No. 428,338, filed Apr. 25, 1995, which is also incorporated herein by reference.

SUMMARY OF THE INVENTION

The invention provides a nozzle assembly comprising a housing including a central bore including a valve seat, and a spring seat extending transversely to the central bore, a needle member located in the central bore, moveable relative to the housing between an open position and a closed position, and including a valve surface engaged with the valve seat when the needle member is in the closed position, and an end remote from the valve surface, a needle retainer fixed to the needle member and engaging the housing when the needle member is in the open position, a spring retainer fixed to the remote end of the needle member, and a spring bearing against the spring seat and against the spring retainer so as to normally bias the needle member to the closed position.

The invention also provides a nozzle assembly comprising a housing including an outer end, an inner end, a central bore extending between the inner and outer ends and including a valve seat adjacent the outer end of the housing, and a spring seat extending transversely to the central bore, a needle member located in the central bore, moveable relative to the housing between an open position and a closed position, and including a valve surface engaged with the valve seat when the needle member is in the closed position, and an inner end, a needle retainer fixed to the needle member in spaced relation to the inner end of the housing and so as to engage the inner end of the housing when the needle member is in the open position, a spring retainer fixed to the inner end of the needle member, and a spring normally biasing the needle member to the closed position and including a first end bearing against the spring seat of the housing, and a second end bearing against the spring retainer.

The invention also provides a method of fabricating a nozzle assembly comprising the steps of fabricating a housing including an end defining a valve seat, an end remote from the valve seat end, a central bore extending between the valve seat end and the remote end, and a spring seat extending transversely to the central bore, fabricating a needle member including a valve surface and a retainer end spaced from the valve surface, inserting the needle member into the central bore of the housing for movement of the needle member relative to the housing between an open position and a closed position and with the valve surface of the needle member projecting beyond the valve seat and with the retainer end projecting beyond the remote end of the housing, placing a needle retainer on the needle member and in engagement with the remote end of the housing, fixing the needle retainer to the needle member when the needle retainer is in engagement with the remote end of the housing and when the valve surface is spaced from the valve seat at a predetermined distance so as thereby to define the maximum lift of the valve surface from the valve seat when the needle member is in the open position, placing a spring having first and second ends in encircling relation to the needle member and with the first end in engagement with the spring seat of the housing, placing a spring retainer on the retainer end of the needle member and in engagement with the second end of the spring, and fixing the spring retainer to the retainer end of the needle member when the spring retainer is at a predetermined distance from the spring seat so as thereby to define the installed height of the spring when the needle member is in the closed position.

Other features and advantages of the invention will become apparent to those skilled in the art upon review of the following detailed description, claims and drawings.

Figure 1:
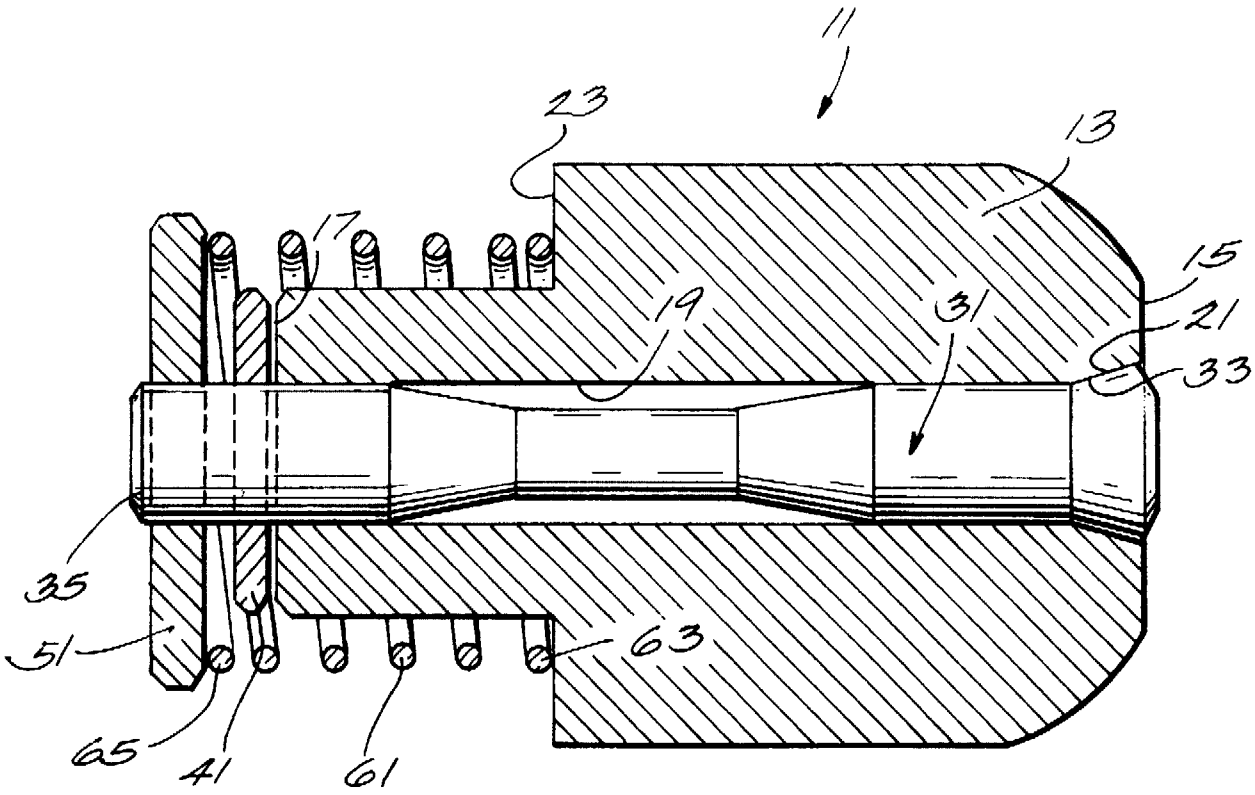
FIG. 1 is schematic elevational view of a nozzle assembly incorporating various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown in the drawing is a nozzle assembly 11 including a housing 13 comprising an outer or valve seat end 15, an inner or remote end 17 spaced axially from the valve seat end 15, a central bore 19 extending between the valve seat and remote ends 15 and 17 and including a valve seat 21 located adjacent the outer end 15 of the housing 13, and a spring seat or bearing surface 23 extending transversely to the central bore. Preferably, the spring seat 23 is located intermediate the valve seat and remote ends 15 and 17.

In addition, the nozzle assembly 11 includes a needle or needle member 31 located in the central bore 19, moveable relative to the housing 13 between an open position and a closed position, and including a valve surface 33 engaged with the valve seat 21 when the needle member 31 is in the closed position. The needle member 31 also includes a retainer or inner end 35 which projects axially beyond the remote end 17 of the housing 13.

The nozzle assembly 11 also includes a needle retainer 41 which can be in the form of a washer and which is fixed to the needle member 31 in spaced relation to the retainer end 35 of the needle member, which abuts the remote end 17 of the housing 13 when the needle member 31 is in the open position and is spaced from the housing remote end when the needle member is in the closed position.

The nozzle assembly 11 also includes a spring retainer 51 which can also be in the form of a washer and which is fixed near to the retainer end 35 of the needle member 31 and spaced from the needle retainer washer 41. The nozzle assembly 11 also includes a spring 61 which normally biases the needle member 31 to the closed position and which includes a first end 63 bearing against the spring seat 23 of the housing 13, and a second end 65 bearing against the spring retainer 51.

The housing 13 and the needle member 31 can be constructed or fabricated in any suitable manner from any suitable material.

The needle retainer 41 and the spring retainer 51 can be fabricated in any suitable manner from any suitable material.

Any suitable construction for the spring 61 can be employed and, in the disclosed construction, a helical spring is employed.

In accordance with the method of the invention, the nozzle assembly 11 is fabricated employing the step of fabricating a housing 13 including the valve seat end 15, the valve seat 21, the remote end 17, the central bore 19 extending between the valve seat end 15 and the remote end 17, and the spring seat 23 extending transversely to the central bore 19.

The method of the invention also includes the step of fabricating the needle member 31 including the valve surface 33 and the retainer end 35 spaced from the valve surface 33.

In addition the method of the invention also includes the step of inserting the needle member 31 into the central bore 19 of the housing 13 for movement of the needle member 31 relative to the housing 13 between an open position and a closed position and with the valve surface 33 of the needle member 31 projecting beyond the valve seat 21 when in the open position and with the retainer end 35 projecting beyond the remote end 17 of the housing 13 in both the open and the closed positions.

Thereafter, the method of the invention includes the step of placing a needle retainer 41 on the needle member 31 and in abutment with the remote end 17 of the housing 13.

Thereafter, and in addition, the method of the invention includes the step of fixing the needle retainer 41 to the needle member 31 when the needle retainer 41 is in abutment with the remote end 17 of the housing 13 and when the valve surface 33 is spaced from the valve seat 21 at a predetermined distance so as thereby to define the maximum lift of the valve surface 33 from the valve seat 21 when the needle member 31 is in the open position.

Still further in addition, the method of the invention includes the step of placing a spring 61 (having first and second ends 63 and 65) in encircling relation to the needle member 31 and with the first end 63 in engagement with the spring seat 23 of the housing 13.

Thereafter, the method of the invention includes the steps of placing a spring retainer 51 on the retainer end 35 of the needle member 31 and in engagement with the second end 65 of the spring 61, and, finally, fixing the spring retainer 51 to the remote retainer end 35 of the needle member 31 when the spring retainer 51 is at a predetermined distance from the spring seat 23 so as thereby to define the installed height of the spring 61 when the needle member is in the closed position.

Any suitable technique, such as welding, can be employed to fix the needle retainer 51 to the needle member 31, and any suitable technique, such as welding, can be employed to fix the needle retainer 51 to the needle member 31.

A principal advantage of the disclosed construction and assembly method is that the spring preload tolerance can be relaxed to allow economic manufacture of the springs 61 because the assembled preload is controlled in the assembly process instead of the component manufacturing process.

As explained above, the disclosed construction separates the needle lift from the installed height dimension which determines the assembled preload.

After placement of the needle retainer 41 on the needle member 31 and in engagement with the housing end 17 remote from the valve seat 21, the needle lift is set, possibly with a shim, incident to fixing, as by welding or other suitable technique, of the needle retainer 41 to the needle member 31 when the needle member 31 is in the maximum open position.

After placement of the spring 61 on the housing 13 with one end engaged with the spring seat 23, and after placement of the spring retainer 51 on the needle member 31 and in engagement with the other or adjacent end 65 of the spring 61, the installed height is set, possibly with a force transducer, incident to fixing, as by welding or other suitable technique, of the spring retainer 51 to the needle member 31 when the needle member 31 is in the closed position, to thereby complete the nozzle assembly 11.

Various of the features are set forth in the following claims.

I claim:

1. A method of fabricating a nozzle assembly comprising the steps of fabricating a housing including an end defining a valve seat, an end remote from the valve seat end, a central bore extending between the valve seat end and the remote end, and a spring seat extending transversely to the central bore, fabricating a needle member including a valve surface and a retainer end spaced from the valve surface, inserting the needle member into the central bore of the housing for movement of the needle member relative to the housing between an open position and a closed position and with the valve surface of the needle member projecting beyond the valve seat and with the retainer end projecting beyond the remote end of the housing, placing a needle retainer on the needle member and in engagement with the remote end of the housing, fixing the needle retainer to the needle member when the needle retainer is in engagement with the remote end of the housing and when the valve surface is spaced from the valve seat at a predetermined distance so as thereby to define the maximum lift of the valve surface from the valve seat when the needle member is in the open position, placing a spring having first and second ends in encircling relation to the needle member and with the first end in engagement with the spring seat of the housing, placing a spring retainer on the retainer end of the needle member and in engagement with the second end of the spring, and fixing the spring retainer to the retainer end of the needle member when the spring retainer is at a predetermined distance from the spring seat so as thereby to define the installed height of the spring when the needle ember is in the closed position.

2. A method for assembling a nozzle comprising the steps of:

providing a housing having a first end, a second end and a bore with a valve seat therein;

providing a valve stem needle having a first end and a second, end, said first end having a surface for mating with said valve seat;

inserting said needle into said bore wherein said needle is movable in said bore between a closed position and an open position;

placing a first retainer on said needle near said second end thereof and in abutment with said second end of said housing;

determining the maximum distance that said needle may extend beyond said first end of said housing and thereby separating said valve seat of said housing and said mating surface of said needle;

placing said needle at said maximum distance beyond said first end of said housing;

attaching said first retainer to said needle;

placing a coiled spring having two ends about said needle wherein one end abuts said housing;

closing said needle relative to said housing wherein said valve seat of said housing and said mating surface of said needle are abutting;

determining the biasing force to be induced in said spring when said needle is in said closed position;

placing a second retainer about said needle near said second end thereof and spaced from said first retainer;

compressing said spring by bearing said second retainer against the other of said two ends of said spring whereby said biasing force is created; and attaching said second retainer to said needle.

3. A nozzle assembly comprising:

a housing having a first end, a second end, an intermediate seat surface and a bore;

a needle having a first end and a second end located in said bore and movable longitudinally along said bore between two positions, an open position and a closed position;

a first retainer attached to said needle near said second end thereof for limiting movement of said needle relative to said housing;

a biasing spring having two ends, one of said ends abutting said intermediate seat surface of said housing; and a second retainer attached to said needle spaced from said first retainer in a direction toward said second end of said needle and abutting the other of said two ends of said spring, wherein said first retainer is positioned on said needle at a distance from said second end of said housing equal to the distance that said needle may move relative to said housing when said needle moves from said closed position to said open position, and wherein said second retainer is attached to said needle at a location that is a function of the initial load predetermined to be placed on said spring, which load must be overcome to move said needle from said closed position to said open position.

4. A nozzle assembly as claimed in claim 3 wherein:

said housing includes a valve seat formed in said bore adjacent said first end of said housing; and said needle includes a valve stem adjacent said first end of said needle.

5. A nozzle assembly as claimed in claim 3 wherein:

said spring comprises a helically disposed wire.

* * * * *